US006170566B1

(12) United States Patent
Blumel et al.

(10) Patent No.: US 6,170,566 B1
(45) Date of Patent: Jan. 9, 2001

(54) HIGH PERFORMANCE LOUVERED FIN FOR A HEAT EXCHANGER

(75) Inventors: Barry W. Blumel, Livonia; Eugene G. Rhodes, Belleville; Ajit R. Shembekar, Farmington Hills, all of MI (US)

(73) Assignee: Visteon Global Technologies, Inc., Dearborn, MI (US)

( * ) Notice: Under 35 U.S.C. 154(b), the term of this patent shall be extended for 0 days.

(21) Appl. No.: 09/470,369

(22) Filed: Dec. 22, 1999

(51) Int. Cl.[7] ..... F28F 1/22
(52) U.S. Cl. ..... 165/152; 165/153; 165/DIG. 487
(58) Field of Search ..... 165/152, 153, 165/166, 167, DIG. 487

(56) References Cited

U.S. PATENT DOCUMENTS

| | | | | |
|---|---|---|---|---|
| 1,800,853 | * | 4/1931 | Yeager | 165/152 |
| 2,035,665 | * | 3/1936 | Palmer | 165/153 |
| 3,009,389 | | 11/1961 | Ewing . | |
| 3,250,325 | | 5/1966 | Rhodes et al. . | |
| 3,265,127 | * | 8/1966 | Nickol et al. | 165/152 |
| 3,449,552 | | 6/1969 | Graves . | |
| 3,724,538 | | 4/1973 | Yamaguchi et al. . | |
| 3,993,125 | | 11/1976 | Rhodes . | |
| 4,311,193 | * | 1/1982 | Verhaeghe et al | 165/149 |
| 4,676,304 | * | 6/1987 | Loisuka et al. | 165/152 |
| 4,815,532 | * | 3/1989 | Sasaki et al. | 165/152 |
| 5,669,438 | * | 9/1997 | Beales et al. | 165/152 |
| 5,730,214 | * | 3/1998 | Beamer et al. | 165/152 |
| 5,787,972 | * | 8/1998 | Beamer et al. | 165/152 |

FOREIGN PATENT DOCUMENTS 218029 7/1924 (GB) .

* cited by examiner

*Primary Examiner*—Ira S. Lazarus
*Assistant Examiner*—Terrell McKinnon
(74) *Attorney, Agent, or Firm*—Larry I. Shelton

(57) ABSTRACT

A high performance louvered fin for a heat exchanger includes a base wall extending longitudinally to form a strip having a longitudinal axis. The high performance louvered fin includes a plurality of entrance louvers in the base wall extending outwardly at a predetermined angle in a first direction from the base wall. The high performance louvered fin also includes a plurality of exit louvers in the base wall extending outwardly at a predetermined angle in a second direction from the base wall reversed from the first direction. The entrance louvers and the exit louvers extend in a direction parallel to the longitudinal axis and are spaced laterally. The high performance louvered fin further includes a turnaround rib in the base wall extending laterally and generally perpendicular to the longitudinal axis between the entrance louvers and the exit louvers.

21 Claims, 2 Drawing Sheets

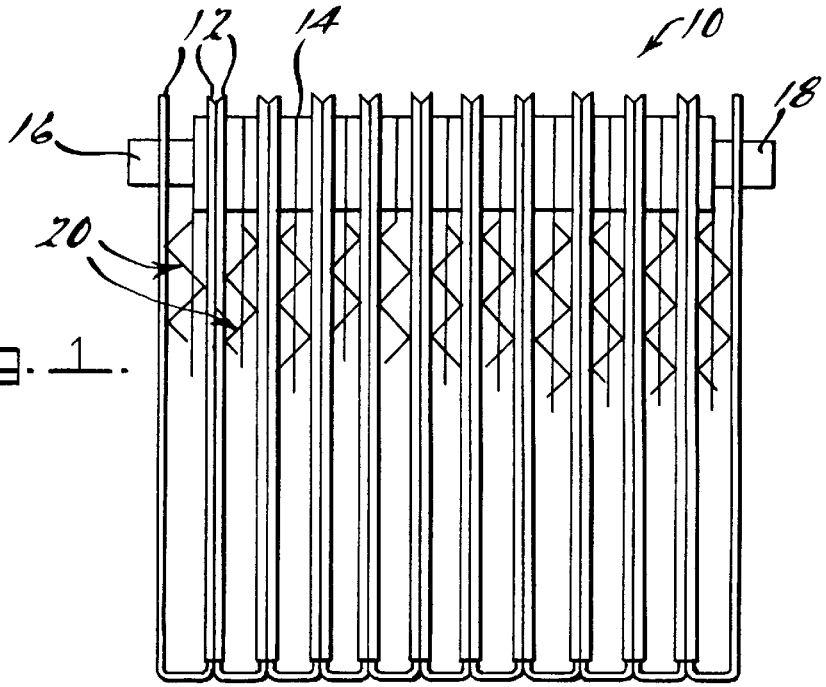
FIG. 1.
FIG. 2.
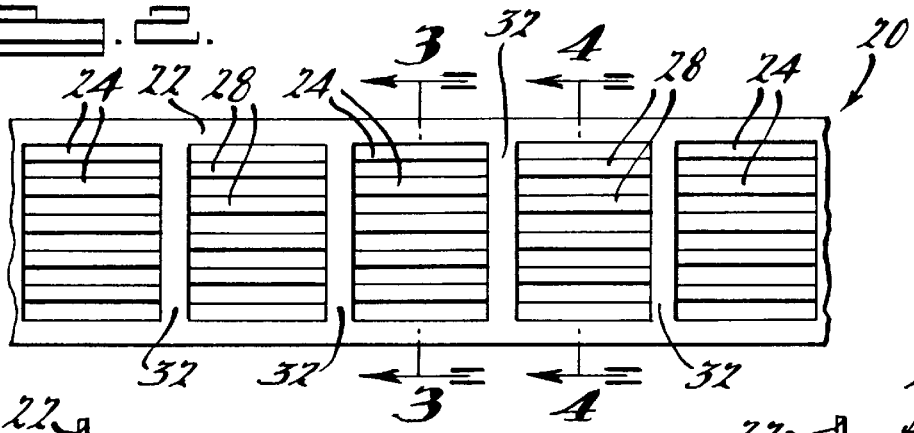
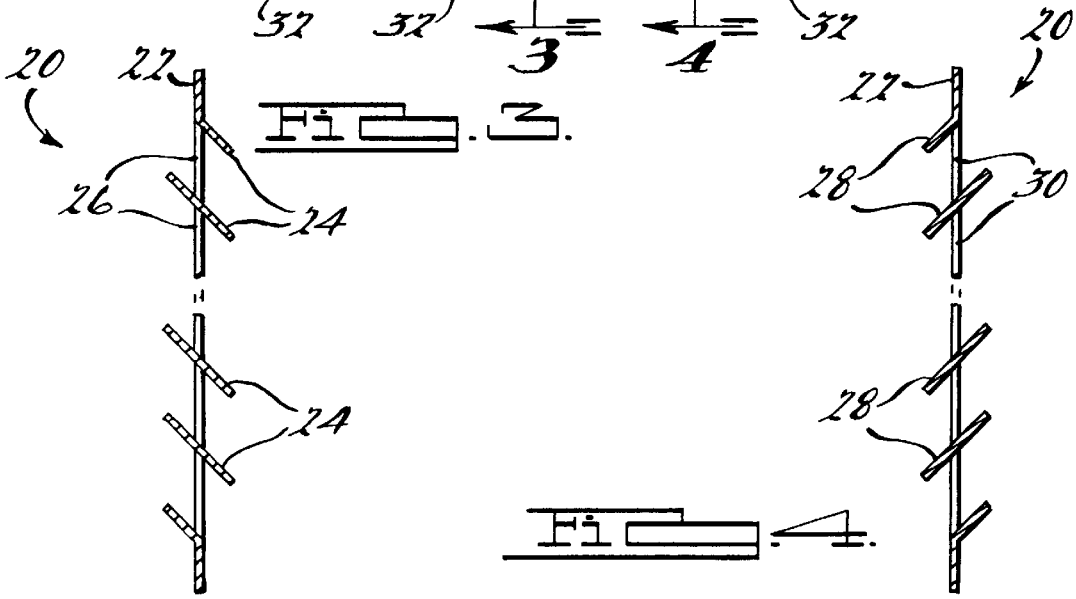
FIG. 3.
FIG. 4.

FIG. 5.
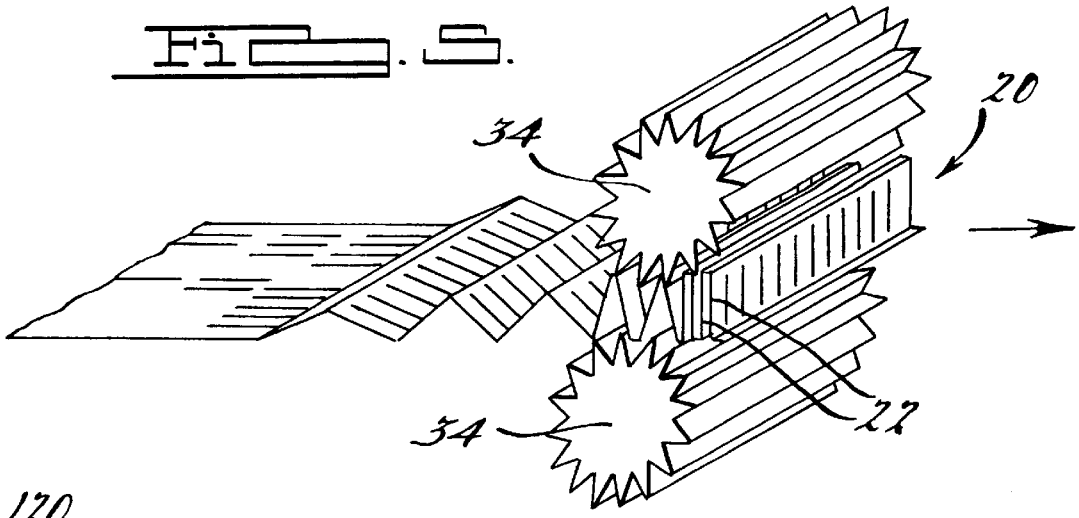
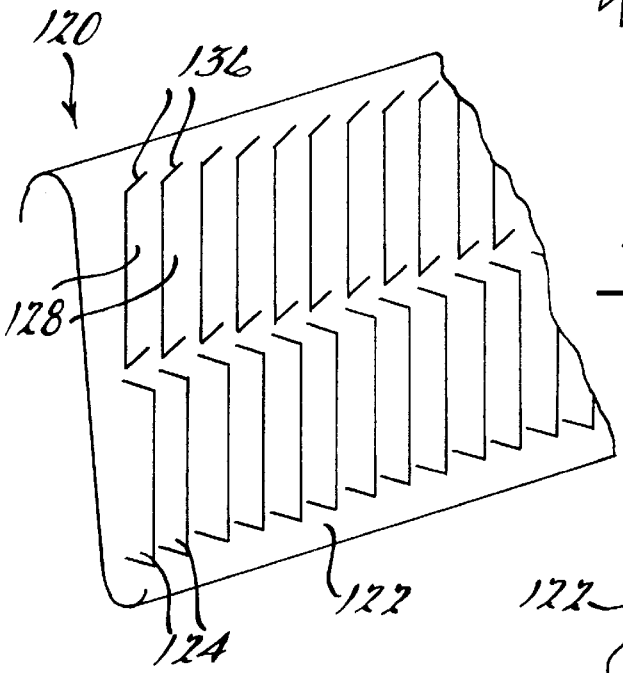
FIG. 6.
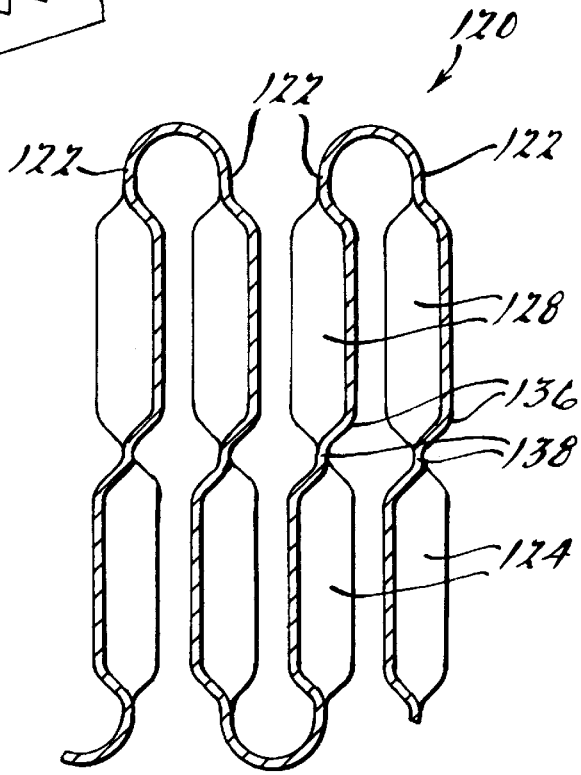
FIG. 7.

HIGH PERFORMANCE LOUVERED FIN FOR A HEAT EXCHANGER

BACKGROUND OF THE INVENTION

1. Field of the Invention

The present invention relates generally to heat exchangers for motor vehicles and, more specifically, to a high performance louvered fin for a heat exchanger in a motor vehicle.

2. Description of the Related Art

It is known to provide a louvered fin for a heat exchanger such as an evaporator in a motor vehicle. An example of such a louvered fin is disclosed in U.S. Pat. No. 5,738,168. The louvered fin typically is a corrugated fin having generally planar walls joined in a "V" shape at crests. The louvered fin also has a plurality of louvers bent integrally out of the walls at an angle for the purpose of breaking up airflow over the fins and increasing heat transfer. Further, the louvered fin may have multiple louvers in which the louvers are divided into a pattern of alternating, adjacent sets of louvers to guide airflow in an attempt to induce turbulent flow therein. Commonly, two sets of louvers are used, an entrance set and an exit set separated from one another by a central portion. When air flows over the walls of the louvered fin, the airflow will engage the louvers of the entrance set and be deflected upwardly through the wall at the angle of the entrance set of louvers. Air in the deflected stream flows between a pair of adjacent central portions in two adjacent walls. The air is deflected back through the louvers of the exit set in the same way. It should be appreciated that the airflow has a generally shallow bell curve shape.

Another known louvered fin for a heat exchanger such as an evaporator is disclosed in U.S. Pat. No. 4,580,624. In this patent, groups of louvers are sloped alternately or in different combinations on the fin.

Other examples of known fins for heat exchangers are disclosed in U.S. Pat. No. 3,214,954 and Japanese Patent No. 10-141805. U.S. Pat. No. 3,214,954 discloses a fin roll and Japanese Patent No. 10-141805 discloses a multi-stage fin.

Although the above fins have worked for a heat exchanger, it is desirable to provide a corrugated fin that allows louvers to direct air through the heat exchanger core with minimum turning while maximizing the number of louvers within the airstream for increased heat transfer. It is also desirable to provide a split louver that allows each section of the louver to maintain and direct airflow in a single direction for a minimum drop in airside pressure for increased heat transfer. Therefore, there is a need in the art to provide a louvered fin for a heat exchanger that outperforms conventional louvered fins in both heat transfer and air pressure drop.

SUMMARY OF THE INVENTION

Accordingly, the present invention is a high performance louvered fin for a heat exchanger including a base wall extending longitudinally to form a strip having a longitudinal axis. The high performance louvered fin includes a plurality of entrance louvers in the base wall extending outwardly at a predetermined angle in a first direction from the base wall. The high performance louvered fin also includes a plurality of exit louvers in the base wall extending outwardly at a predetermined angle in a second direction from the base wall reversed from the first direction. The entrance louvers and the exit louvers extend in a direction parallel to the longitudinal axis and are spaced laterally. The high performance louvered fin further includes a turnaround rib in the base wall extending laterally and generally perpendicular to the longitudinal axis between the entrance louvers and the exit louvers.

One advantage of the present invention is that a high performance louvered fin for a heat exchanger such as an evaporator is provided for a motor vehicle. Another advantage of the present invention is that the high performance louvered fin has louvers that are twisted within its length such that air passing over the two halves of the louver is directed in different directions. Yet another advantage of the present invention is that the high performance louvered fin allows each section of the louver to maintain and direct airflow in a single direction for minimum drop in airside pressure. Still another advantage of the present invention is that the high performance louvered fin provides more louvers within the airstream, thereby increasing heat transfer. A further advantage of the present invention is that the high performance louvered fin can be roll-formed or stamped from a flat sheet of aluminum and subsequently corrugated using packing rolls to form corrugated louvered fins of required fin density. Yet a further advantage of the present invention is that the high performance louvered fin allows the louvers in a corrugated fin to direct air through the core of the heat exchanger with minimum turning while maximizing the number of louvers within the airstream. Still a further advantage of the present invention if that the high performance louvered fin allows for increased heat transfer even as the air-side pressure drop of the core of the heat exchanger is reduced.

Other features and advantages of the present invention will be readily appreciated, as the same becomes better understood after reading the subsequent description taken in conjunction with the accompanying drawings.

BRIEF DESCRIPTION OF THE DRAWINGS

FIG. 1 is an elevational view of a high performance louvered fin, according to the present invention, illustrated in operational relationship with a heat exchanger.

FIG. 2 is an enlarged plan view of the high performance louvered fin of FIG. 1.

FIG. 3 is a sectional view taken along line 3—3 of FIG. 2.

FIG. 4 is a sectional view taken along line 4—4 of FIG. 2.

FIG. 5 is a perspective view of the high performance louvered fin of FIG. 1 illustrating corrugation thereof.

FIG. 6 is a perspective view of another embodiment, according to the present invention, of the high performance louvered fin of FIG. 1.

FIG. 7 is an enlarged fragmentary view of the high performance louvered fin of FIG. 6.

DESCRIPTION OF THE PREFERRED EMBODIMENT(S)

Referring to the drawings and in particular FIG. 1, one embodiment of a heat exchanger 10, such as an evaporator, is shown for a motor vehicle (not shown). The heat exchanger 10 includes a plurality of generally parallel and U-shaped plates or tubes 12 and a header 14 connected to one end of the tubes 12. The heat exchanger 10 includes a fluid inlet 16 for conducting cooling fluid into the heat exchanger 10 formed in the header 14 and a fluid outlet 18 for directing fluid out of the heat exchanger 10 formed in the header 14. The heat exchanger 10 also includes a plurality of convoluted or serpentine continuous high performance louvered fins, generally indicated at 20 and according to the present invention, attached an exterior of each of the tubes 12. The high performance louvered fins 20 are disposed between each of the tubes 12. The high performance louvered fins 20 serve as a means for conducting heat away from the tubes 12 while providing additional surface area for convective heat transfer by air flowing over the heat exchanger 10. It should be appreciated that, except for the high performance louvered fins 20, the heat exchanger 10 is conventional and known in the art. It should also be appreciated that the high performance louvered fins 20 could be used for heat exchangers in other applications besides motor vehicles.

Referring to FIGS. 2 through 5, the high performance louvered fin 20 includes at least one, preferably a plurality of base walls 22 joined to one another in generally "V" shaped corrugations. Each base wall 22 is generally planar and rectangular shape. Each base wall 22 extends longitudinally to form a strip. The base wall 22 is made of a metal material such as aluminum or an alloy thereof.

The high performance louvered fin 20 also includes a plurality of first or entrance louvers 24 in the base wall 22 extending outwardly at a relatively large or predetermined louver angle such as forty-three degrees (43°) in a first direction from the base wall 22. The entrance louvers 24 are generally planar and rectangular in shape. The entrance louvers 24 extend longitudinally or generally parallel to a longitudinal axis of the base wall 22. The entrance louvers 24 are pierced and bent out of the base wall 22 to form apertures 26 for air to flow therebetween. The entrance louvers 24 are spaced laterally at a relatively small or predetermined louver pitch such as 0.8 millimeters (mm) to 1.0 mm to enhance heat transfer.

The high performance louvered fin 20 includes a plurality of second or exit louvers 28 in the base wall 22 extending outwardly at a relatively large or predetermined louver angle such as forty-three degrees (43°) in a second direction reversed from or opposite the first direction. The exit louvers 28 are generally planar and rectangular in shape. The exit louvers 28 extend longitudinally or generally parallel to the longitudinal axis of the base wall 22. The exit louvers 28 are pierced and bent out of the base wall 22 to form apertures 30 for air to flow therebetween. The exit louvers 28 are spaced longitudinally at a relatively small or predetermined louver pitch such as 0.8 millimeters (mm) to 1.0 mm to enhance heat transfer. It should be appreciated that the louvers 24 and 28 enhance heat transfer performance. It should also be appreciated that the high performance louvered fin 20 is stamped such that the louvers 24 and 28 are orientated in a uniform direction along the entire length thereof. It should further be appreciated that the louvers 24 and 28 in alternate fins are stamped such that they are twisted either into or out of the plane of the high performance louvered fin 10 as illustrated in FIGS. 3 and 4.

The high performance louvered fin 20 further includes a turnaround rib 32 in the base wall 22 spaced between the sets of louvers 24 and 28. The turnaround ribs 32 are generally planar and rectangular in shape. The turnaround ribs 32 extend laterally or generally perpendicular to the longitudinal axis of the base wall 22 with one being disposed between a first set of entrance louvers 24 and a second set of exit louvers 28. The high performance louvered fin 20 is formed as a monolithic structure being integral, unitary and one-piece. The high performance louvered fin 20 is stamped by conventional stamping processes to form the louvers 24 and 28 and sent onward to packaging rollers 34 where it is corrugated into the style of a typical louvered fin as illustrated in FIG. 5.

In operation of the high performance louvered fin 20, air flows between the base walls 22. The air engages the entrance louvers 24 and is deflected through the apertures 26 of the base wall 22. The deflected air is impacted by air flowing straight between the base walls 22. The air flows past the turn-around rib 32 and engages the exit louvers 28 and is deflected through the apertures 30 in the base wall 22.

Referring to FIGS. 6 and 7, another embodiment 120, according to the present invention, of the high performance louvered fin 20 is shown. Like parts of the high performance louvered fin 20 have like reference numerals increased by one hundred (100). In this embodiment, the high performance louvered fin 120 has a split louver 136 for the entrance louvers 124 and exit louvers 128 formed from the base wall 122 disposed above and below a plane of the base wall 122. The split louvers 136 extend longitudinally and are spaced laterally along the base wall 122. The split louvers 136 have a twist 138 within a length thereof that forms the entrance louvers 124 and exit louvers 128 above and below a plane of the base wall 122 and allows air to be directed in different directions. It should be appreciated that the airstream only traverses along the width of the split louvers 136 and not along the length thereof for the high performance louvered fin 120.

The present invention has been described in an illustrative manner. It is to be understood that the terminology which has been used is intended to be in the nature of words of description rather than of limitation.

Many modifications and variations of the present invention are possible in light of the above teachings.

Therefore, within the scope of the appended claims, the present invention may be practiced other than as specifically described.

What is claimed is:

1. A high performance louvered fin for a heat exchanger comprising:

a base wall extending longitudinally to form a strip having a longitudinal axis;

a plurality of entrance louvers in said base wall extending outwardly at a predetermined angle in a first direction from said base wall;

a plurality of exit louvers in said base wall extending outwardly at a predetermined angle in a second direction from said base wall reversed from the first direction, the first direction and the second direction being perpendicular to the longitudinal axis;

said entrance louvers and said exit louvers extending in a direction parallel to the longitudinal axis and being spaced laterally; and a turnaround rib in said base wall extending laterally and generally perpendicular to the longitudinal axis between said entrance louvers and said exit louvers.

2. A high performance louvered fin as set forth in claim 1 wherein said base wall is generally planar and rectangular in shape.

3. A high performance louvered fin as set forth in claim 1 wherein said base wall includes a plurality of first apertures extending therethrough, one of said first apertures being disposed between an adjacent pair of said entrance louvers for air to flow therebetween.

4. A high performance louvered fin as set forth in claim 3 wherein each of said entrance louvers are formed from said base wall at the angle to form said first apertures.

5. A high performance louvered fin as set forth in claim 1 wherein said base wall includes a plurality of second apertures extending therethrough, one of said second apertures being disposed between an adjacent pair of said exit louvers for air to flow therebetween.

6. A high performance louvered fin as set forth in claim 5 wherein each of said exit louvers are formed from said base wall at said predetermined angle to form said second apertures.

7. A high performance louvered fin as set forth in claim 1 including a plurality of said base walls joined to one another in generally V shaped corrugations.

8. A high performance louvered fin as set forth in claim 1 wherein said base wall, said entrance louvers, and said exit louvers are integral, unitary and formed as one-piece.

9. A high performance louvered fin as set forth in claim 1 including a plurality of split louvers extending laterally and generally parallel to the longitudinal axis, one of said entrance louvers and one of said exit louvers being formed on one of said split louvers.

10. A high performance louvered fin for a heat exchanger comprising:

a base wall extending longitudinally to form a strip having a longitudinal axis;

a plurality of entrance louvers in said base wall extending outwardly at a predetermined angle in a first direction from said base wall;

a plurality of exit louvers in said base wall extending outwardly at a predetermined angle in a second direction from said base wall reversed from the first direction;

said entrance louvers and said exit louvers extending in a direction parallel to the longitudinal axis and being spaced laterally; and a turnaround rib in said base wall extending laterally and generally perpendicular to the longitudinal axis between said entrance louvers and said exit louvers; and wherein said entrance louvers extend above and below a plane of said base wall.

11. A high performance louvered fin for a heat exchanger comprising:

a base wall extending longitudinally to form a strip having a longitudinal axis;

a plurality of entrance louvers in said base wall extending outwardly at a predetermined angle in a first direction from said base wall;

a plurality of exit louvers in said base wall extending outwardly at a predetermined angle in a second direction from said base wall reversed from the first direction;

said entrance louvers and said exit louvers extending in a direction parallel to the longitudinal axis and being spaced laterally; and a turnaround rib in said base wall extending laterally and generally perpendicular to the longitudinal axis between said entrance louvers and said exit louvers; and wherein said exit louvers extend above and below a plane of said base wall.

12. A high performance louvered fin for a heat exchanger comprising:

a base wall extending longitudinally to form a strip having a longitudinal axis;

a plurality of entrance louvers in said base wall extending outwardly at a predetermined angle in a first direction from said base wall;

a plurality of exit louvers in said base wall extending outwardly at a predetermined angle in a second direction from said base wall reversed from the first direction;

said entrance louvers and said exit louvers extending in a direction perpendicular to the longitudinal axis and being spaced laterally; and a plurality of split louvers extending laterally and generally parallel to the longitudinal axis, one of said entrance louvers and one of said exit louvers being formed on one of said split louvers; and wherein said split louvers are twisted to form one of said entrance louvers above a plane of said base wall and one of said exit louvers below a plane of said base wall.

13. A high performance louvered fin for a heat exchanger comprising:

a base wall extending longitudinally to form a strip having a longitudinal axis;

a plurality of entrance louvers in said base wall extending outwardly at a predetermined angle in a first direction from said base wall;

a plurality of exit louvers in said base wall extending outwardly at a predetermined angle in a second direction from said base wall reversed from the first direction;

said entrance louvers and said exit louvers extending in a direction parallel to the longitudinal axis and being spaced laterally and extending above and below a plane of said base wall; and a turnaround rib in said base wall extending laterally and generally perpendicular to the longitudinal axis between said entrance louvers and said exit louvers.

14. A high performance louvered fin as set forth in claim 13 wherein said base wall is generally planar and rectangular in shape.

15. A high performance louvered fin as set forth in claim 13 including a plurality of split louvers extending laterally and generally parallel to the longitudinal axis, one of said entrance louvers and one of said exit louvers being formed on one of said split louvers.

16. A high performance louvered fin as set forth in claim 15 wherein said split louvers are twisted to form one of said entrance louvers above a plane of said base wall and one of said exit louvers below a plane of said base wall.

17. A high performance louvered fin as set forth in claim 13 including a plurality of said base walls joined to one another in generally V shaped corrugations.

18. A high performance louvered fin as set forth in claim 13 wherein said base wall, said entrance louvers, said exit louvers are integral, unitary and formed as one-piece.

19. A high performance louvered fin as set forth in claim 13 wherein said base wall is made of a metal material.

20. A heat exchanger comprising:

a plurality of tubes;

a plurality of high performance louvered fins disposed between each of said tubes; and each of said high performance louvered fins comprising a base wall extending longitudinally to form a strip having a longitudinal axis, a plurality of entrance louvers in said base wall extending outwardly at a predetermined angle in a first direction from said base wall, a plurality of exit louvers in said base wall extending outwardly at a predetermined angle in a second direction from said base wall reversed from the first direction, said entrance louvers and said exit louvers extending in a direction parallel to the longitudinal axis and being spaced laterally and extending above and below a plane of said base wall, and a turnaround rib in said base wall extending laterally and generally perpendicular to the longitudinal axis between said entrance louvers and said exit louvers.

21. A high performance louvered fin for a heat exchanger comprising:

a base wall extending longitudinally to form a strip having a longitudinal axis;

a plurality of entrance louvers in said base wall extending outwardly at a predetermined angle in a first direction from said base wall;

a plurality of exit louvers in said base wall extending outwardly at a predetermined angle in a second direction from said base wall reversed from the first direction, the first direction and the second direction being parallel to the longitudinal axis;

said entrance louvers and said exit louvers extending in a direction perpendicular to the longitudinal axis and being spaced laterally; and a twist in said base wall extending longitudinally and generally parallel to the longitudinal axis between said entrance louvers and said exit louvers.

* * * * *